US008955593B2

(12) United States Patent
Batista De Barros

(10) Patent No.: US 8,955,593 B2
(45) Date of Patent: Feb. 17, 2015

(54) DAMPING SLEEVE AND ANCHORING METHOD

(71) Applicant: Petróleo Brasileiro S.A.-Petrobras, Rio de Janeiro, RJ (BR)

(72) Inventor: Sergio Batista De Barros, Macaé (BR)

(73) Assignee: Petroleo Brasileiro S.A.-Petrobras, Rio de Janeiro (BR)

( * ) Notice: Subject to any disclaimer, the term of this patent is extended or adjusted under 35 U.S.C. 154(b) by 0 days.

(21) Appl. No.: 13/731,534

(22) Filed: Dec. 31, 2012

(65) Prior Publication Data

US 2013/0168103 A1 Jul. 4, 2013

(30) Foreign Application Priority Data

Dec. 29, 2011 (BR) ..... 1106877

(51) Int. Cl.
*E21B 17/01* (2006.01)
*E21B 19/00* (2006.01)
*E21B 43/01* (2006.01)

(52) U.S. Cl.
CPC ..... *E21B 19/004* (2013.01); *E21B 17/017* (2013.01); *E21B 43/0107* (2013.01)
USPC ..... 166/345; 166/352; 166/367; 405/168.1; 405/224.3

(58) Field of Classification Search
CPC E21B 17/017; E21B 43/0107; E21B 43/0135
USPC ..... 166/360, 343, 345, 352, 367; 138/106, 138/107, 110; 405/168.1, 168.2, 184.4, 405/224.3, 224.4
See application file for complete search history.

(56) References Cited

U.S. PATENT DOCUMENTS

| | | | | |
|---|---|---|---|---|
| 4,808,034 | A * | 2/1989 | Birch | 405/195.1 |
| 5,437,518 | A * | 8/1995 | Maloberti et al. | 405/169 |
| 5,947,642 | A * | 9/1999 | Teixeira et al. | 405/195.1 |
| 6,220,303 | B1 * | 4/2001 | Secher et al. | 138/110 |
| 6,352,115 | B1 * | 3/2002 | Mathieu | 166/352 |
| 6,422,316 | B1 * | 7/2002 | Schutz et al. | 166/367 |
| 6,558,084 | B2 * | 5/2003 | Moog et al. | 405/224 |
| 6,688,930 | B2 * | 2/2004 | Cottrell et al. | 441/5 |
| 7,069,958 | B2 * | 7/2006 | Filho et al. | 138/153 |
| 7,210,504 | B2 * | 5/2007 | Filho et al. | 138/153 |
| 7,575,254 | B2 * | 8/2009 | Cunha Xavier et al. | 285/45 |
| 8,196,666 | B2 * | 6/2012 | Askestad | 166/367 |
| 8,596,912 | B2 * | 12/2013 | Routeau et al. | 405/168.1 |
| 2005/0166988 | A1 * | 8/2005 | Filho et al. | 138/153 |
| 2005/0194782 | A1 * | 9/2005 | Duggan | 285/114 |
| 2008/0295912 | A1 * | 12/2008 | Louvain-Walters | 138/172 |
| 2009/0020061 | A1 * | 1/2009 | Dybvik et al. | 114/230.28 |
| 2010/0213015 | A1 * | 8/2010 | Clevelario et al. | 188/65.1 |

* cited by examiner

*Primary Examiner* — Matthew Buck
(74) *Attorney, Agent, or Firm* — Nixon & Vanderhye P.C.

(57) ABSTRACT

The present invention relates to an accessory device which comprises a damping sleeve (100), which is coupled to a bend stiffener (4), capable of acting in the anchoring operation of a riser (3) so as to eliminate the need for fuse cables and safety straps, the need to use a team of divers, and to guarantee the implementation of the operation in all sea conditions.

10 Claims, 3 Drawing Sheets

Fig. 1 - PRIOR ART

DAMPING SLEEVE AND ANCHORING METHOD

This application claims priority to BR Patent Application No. PI 1106877-9 filed 29 Dec. 2011, the entire content of which is hereby incorporated by reference.

FIELD OF THE INVENTION

The present invention relates to an accessory for the installation and positioning of lines of importation/exportation, production collection and injection of water and gas, in the hull of oil production units, such as SPUs (Stationary Production Units), and FPSOs (Floating Production Storage and Offloading). The proposed technology enables the coupling of the assembly formed by a cap and a bend stiffener to the bell mouth without the need for a fuse cable, and at the same time ensures that the bend stiffener remains in one piece in the event that it falls during the anchoring process.

DESCRIPTION OF THE RELATED ART

For offshore oil production, a pipe assembly is used, which drains the product from a production well in the seabed to a platform, on the surface of the sea. This set of pipes (electro-hydraulic umbilicals, water injection and oil and gas pumping) is traditionally called a production collection line, known in technical terms as a "riser".

This pipe assembly, which forms a production collection line, can essentially be subdivided into two separate sections:

- The first section, substantially horizontal, formed from flexible or rigid piping, which links the oil well in the seabed to a point beneath the platform location, is called a horizontal collection tract, this tract being static and known in technical terms as "flow".
- The second section, formed by a substantially vertical pipeline, connected to the horizontal tract which ascends from the seabed to the platform, where it is coupled, is called a vertical collection tract, known in technical terms as a "riser".

Frequently, owing to the distance between the submarine oil well and the platform, the production collection line is arranged on the seabed by a specific vessel for this purpose, known as a "PLSV" (Piping Laying Support Vessel). The line is released from the production well over large distances reaching five kilometers, to the platform.

The process is started by the coupling of one of the two ends of the piping to the production well, and subsequently, the piping gets released from the production well to the platform for the vessel, which gradually uncoils the piping from its deck as it moves, until it reaches the platform, where it is transferred to the other free end which will have been previously fixed to the platform. This final stage is very laborious, and requires the logistics of various simultaneous and synchronised procedures.

The end of the collection line is prepared with its respective fixing/coupling elements and respective processes known in the prior art, which enable the connection to the platform.

The first anchoring location, and the most used, is on the level of the lower deck of the platform, or, in technical terms, the "spider deck". When this type of anchoring is employed, the production collection line as well as the hydraulic and "gas lift" umbilicals, must be directed individually, by means of an element known as "I-Tube". In turn, the I-Tube is fixed on the internal or external flanks of the floats, structures located beneath the water line which support the platform, or in technical terms, the "pontoon".

When anchoring is carried out on the level of the lower deck, it is well known that there is a bend stiffener, coupled to a guide piece called a "cap", with which the body of the collection line is fitted. The latter remains locked in a bell mouth, to which it is coupled in the lower part of the I-Tube.

Through an increase in the lifting load of the collection line, the fuse cables which keep the cap/bend stiffener coupled to the end of the collection line, or in technical terms, the "end fitting", are broken. With the breakage it is possible that the collection line will continue to be moved by traction and will rise inside the I-Tube up to the level of the lower deck, where it is fixed on its respective support, by means of a bipartite stopper, or in technical terms, a "hang-off", which supports all of the vertical weight of the collection line, whilst the axial loads are supported by the cap/bend stiffener assembly.

In this known concept of the anchoring of the lines to the platform, the process of interconnecting the flexible ducts requires the presence of divers. This requirement is mainly due to the moment of arrival of the "cap and bend stiffener" near to the bell mouth, so that the interconnection of the ends of the cables/safety straps can be carried out. These cables/straps sent by the PLSV are tied to the bend stiffener and to the lugs/existing structures around the bell mouth, so as to prevent this assembly from falling, in the event that the cap is not connected/moored in the dogs of the bell mouth after the fuse cables are broken.

The weight of the cap/bend stiffener assembly can be up to 10 tons and despite having a stopper in the vertical collection tract approximately 35 meters beneath the operating point, in the event that the connection/mooring of the cap in the dogs of the bell mouth does not effectively occur after the breaking of the fuse cables, the bend stiffener will freely descend via the collection line, its acceleration being extremely violent in this small vertical tract, until it reaches the stopper located just below.

Usually, when this fall occurs, it damages the bend stiffener, meaning that more often than not, it is necessary to replace said stiffener, causing significant losses for the company.

Another problem with the logistics of the connection of the free end of the vertical collection tract to the platform is the operational dependence on a whole structure pre-arranged by the weather and sea conditions, such as the rental of ships, the availability of surface crews, equipment, amongst others.

The whole operation is dependent on the team of shallow divers for the submarine interconnections of the cables and straps, and in the event of adverse sea conditions (wind, currents and significant wave heights), the diver will not be able to make a descent, resulting in waits for the PLSV vessel, the daily rate value of which being quite significant in relation to the value of the project, and even more of a cost is the loss of production owing to not beginning production on the planned date, to the detriment of the company's production targets.

In relation to the damages caused by a potential fall of the bend stiffener, in the prior art, there is a device which aims to assist in damping the impact of said stiffener against the stopper located 35 meters beneath the operating point, in the vertical collection tract.

Technology which is being researched or developed by other companies can be cited, and disclosed by the document US 2010/0213015 of Aug. 26, 2010.

The document discloses a device which, in the event that the bend stiffener falls, encourages the opening of vanes, which generate heterodynamic braking. However, besides employing technology composed of various moving components, which increases the chance of operation failure, this is an expensive device and structurally complex in terms of manufacture.

The damping sleeve and anchoring method proposed here were developed from a paradigm shift from the commonly adopted philosophy that is necessary to use a team of divers to carry out the task of manipulating the cables and straps with the aim of executing the connection/mooring of the cap in the dogs of the bell mouth.

In this sense, an accessory which not only damps the impact of a potential fall of the bend stiffener, but which also gets rid of the dependence on an operation which is so difficult for the diver due to the sea conditions.

The invention described below is the result of ongoing research in this pursuit, the focus of which is targeted at the simplification and reduction of costs in operations of anchoring collection lines to platforms. It also aims to create a new anchoring concept with a respective method for application.

Other objectives trying to be achieved, in addition to the objects of the present invention, namely the damping sleeve and its anchoring method, are as follows:

Facilitating the anchoring of collection lines;

Impact damping in the event of a potential fall of the bend stiffener;

Increasing the reliability of the anchoring of collection lines to the platform;

Substantially decreasing the time needed for collection line anchoring;

Meeting the safety requirements of certified companies;

Eliminating the assistance of divers in anchoring.

SUMMARY OF THE INVENTION

The present invention relates to a damping sleeve, which constitutes an accessory with the aim of assisting with the anchoring of collection lines. The damping sleeve comprises a bipartite structure, with a cylindrical shape, provided with an internal opening (core) which extends coaxially from one end to the other of said structure. Said core has a substantially cylindrical shape with a diameter which is equal to or greater than the external diameter of the collection line.

The structure of the damping sleeve is demarcated by specific tracts, namely, a main body and a lower tract in the form of a ring.

The main body comprises an upper part and an intermediary part, the upper part having a core with a conical shape equivalent to that of the external lower end of the bend stiffener, in which it is directly encased. The intermediary part is provided with a cavity along the entire internal circumference of the core. Said cavity, in turn, is provided with a compression plug, firmly fitted to the production line.

The upper part of the main body is further provided with four lugs, distributed equally along its external edge.

The lower tract is formed by a damping ring fitted directly on the lower end of the intermediary part. Said damping ring follows the shape of the main body of the damping sleeve and has a length equivalent to at least ⅓ of the total length of the damping sleeve.

In a second aspect the invention relates to an anchoring method which eliminates the action of a team of divers, and comprises the following stages:

A—install the damping ring around the collection line directly on the lower end of the bend stiffener, still on the PLSV vessel;

B—connect the winch cable of the platform to a pull sling and transfer the assembly formed by the cap and bend stiffener to the platform, immediately after the preceding stage;

C—start pulling the collection line until the connection of the assembly is made, formed by the cap and the bend stiffener in the dogs of the bell mouth.

D—pass the end of the collection line through the I-Tube and bell mouth;

E—continue pulling the collection line until its end reaches the anchoring point.

BRIEF DESCRIPTION OF THE DRAWINGS

The invention will be described below in more detail, in conjunction with the relevant drawings attached, which, solely by way of example, accompany this account, and form an integral part of it, and in which.

DETAILED DESCRIPTION OF THE INVENTION

The damping sleeve and the anchoring method of the invention were developed from research which was intended to find a concept which eliminated the need to use fuse cables and safety straps, as well as the presence and intervention of a team of divers.

Figure 1:
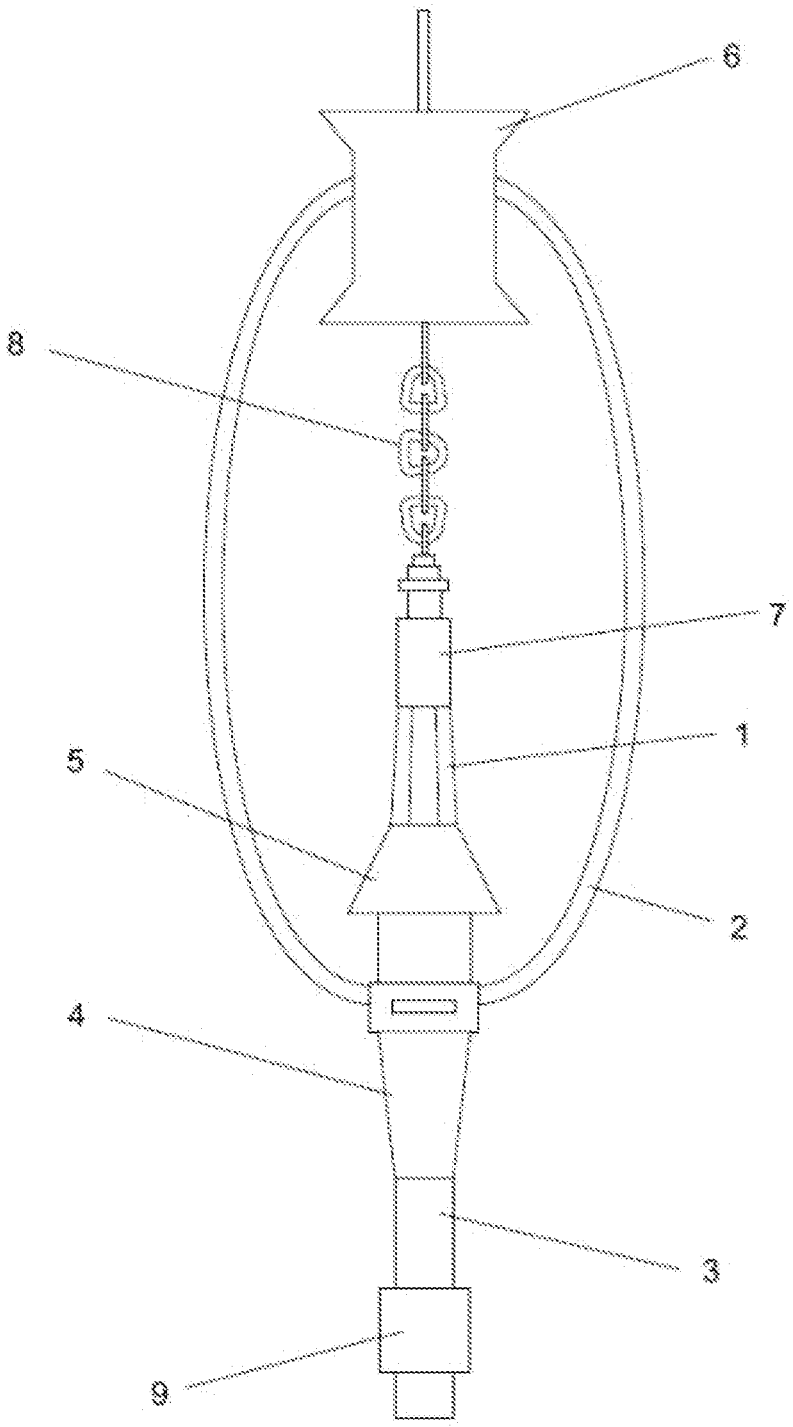
FIG. 1 depicts a cross-sectional schematic view of a device used in the PRIOR ART.

In accordance with the prior art, as can be seen in the diagram presented in FIG. 1, the method by which anchoring is usually carried out using traditional methods is disclosed, with standardised fuse cables (1) and security straps (2).

Despite there currently being various methods to carry out the anchoring of the riser (3), the bell mouth (6), regardless of the sequence chosen for the task, some stages are indispensable, and within them the task of fixing the safety straps (2) between the bend stiffener (4), or cap (5) and the bell mouth (6) carried out by divers, can be cited as a form of preventing the fall of said assembly in the event that said cap (5) is not connected/moored in the dogs around the bell mouth (6) [not depicted], after the breaking of the fuse cables (1).

Another stage which is always present in current methods is the traction of the fuse cables (1) fixed between the end (7) and the cap (5) until this locks in the bell mouth (6). When there is locking between the two components, the riser (3) continues to be moved by traction, by means of a sling (8), until the fuse cables (1) break, subsequently enabling the riser (3) to continue rising until it reaches its final fixing point.

This stage is currently necessary, since in the event that fuse cables were not present (1), it would not be possible to exert the necessary force for the dogs between the bell mouth (6) and the cap (5) to be activated.

This therefore justifies the current need for fuse cables (1) fixing the end fitting (7) to the cap (5) since, if this interconnection did not exist, the traction exerted by the sling (8) to the end fitting (7), and of this to the riser (3), it would not transmitted to the assembly formed by the bend stiffener (4) and the cap (5), in a sufficient manner for the cap (5) to activate the existing dogs around the bell mouth (6). The riser (3), therefore, simply slides inside the bend stiffener (4)/cap (5) assembly when it is moved by traction.

At the moment, in the event that the fuse cables (1) break apart without the cap (5) succeeding to activate the existing dogs around the bell mouth (6), the whole bend stiffener (4)/cap (5) assembly—which weighs around 10 tons—will not have any sustenance and will fall violently until it reaches the stopper (9) of the riser (3).

Figure 2:
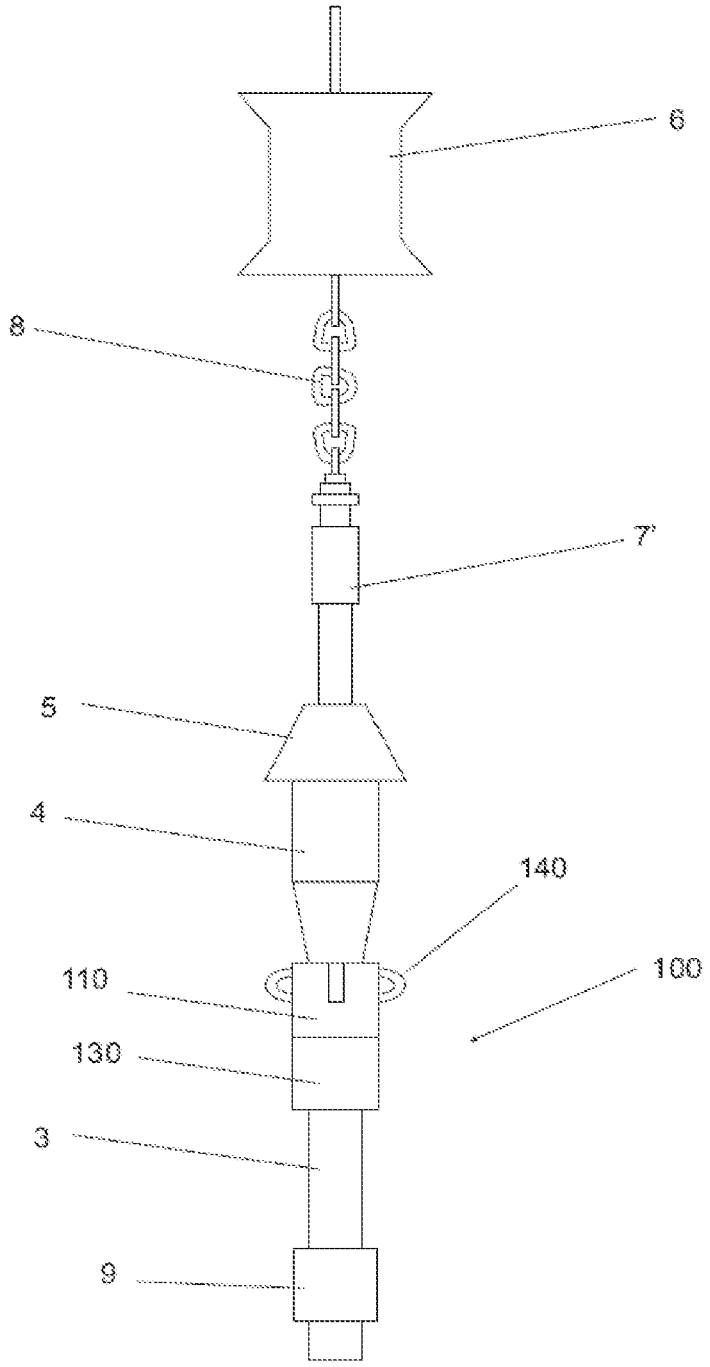
FIG. 2 depicts a first schematic side view of the equipment, object of the invention, in its starting position.

As can be seen highlighted in FIG. 2, in accordance with the new inventive concept which is presented here, there are neither fuse cables nor safety straps.

As will be explained below, it is easy to picture using FIG. 2 and FIG. 3, that this new accessory enables the experts to carry out the whole final operation of anchoring the free end of the riser (3) without the intervention of teams of divers, and without there being any risk of the bend stiffener (4) falling and becoming damaged.

FIG. 2 depicts a schematic side-view image wherein the damping sleeve (100), object of the invention, is arranged in the initial position of the anchoring process of the riser (3) directly encased in said collection line and in the lower part of the bend stiffener (4).

Figure 3:
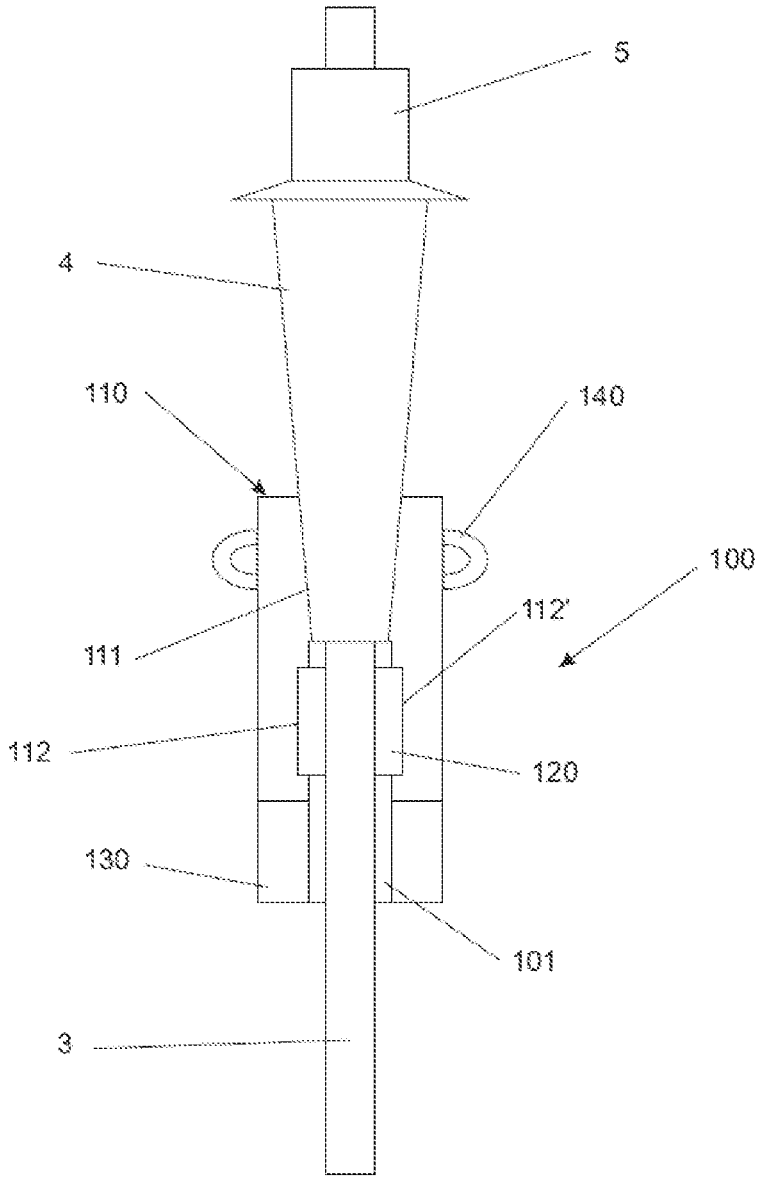
FIG. 3 depicts a second cross-sectional view of the equipment of the invention in its final coupling position.

Better depicted in FIG. 3, in a side, cross-sectional view, it can be seen that the damping sleeve (100), essentially comprises a bipartite structure with a cylindrical shape, fitted with a central opening or core (101), which extends coaxially from one end to the other of said structure. The core (101) has a substantially cylindrical shape with a diameter equal to or greater than the external diameter of the riser (3).

The damping sleeve (100) is coupled on the free end of the riser (3), when it is still on the PLSV vessel, being installed on the lower part of the bend stiffener (4). The coupling is carried out manually by means of screws or any other fixing means, such as a clamp, and eliminates the use of fuse cables connected between the cap (5) and the end fitting/connector (7').

By means of FIG. 3 it is possible to show that the damping sleeve (100) comprises specific tracts, namely: a main body (110) and a lower tract in the form of a ring (130).

The main body (110) comprises an upper part (111) and an intermediary part (112), both of metallic material capable of supporting all of the various forces to which the damping sleeve (100) will be subjected.

The upper section (111) has the core (101) with a conical shape equivalent to that of the lower external end of the bend stiffener (4), in which it is directly encased.

The intermediary part (112) is provided with a cavity (112') along the entire internal circumference of the core (101). Said cavity (112'), in turn, is provided with a compression plug (120), formed from polymeric material, firmly fitted to the riser (3).

Alternatively the compression plug (120), can be formed by two contiguous sections of polymeric materials and both with different properties, each one is programmed and fitted so as to resist specifically limited tensions.

When the bipartite damping sleeve (100) is closed around the riser (3) in its initial working position, the compression plug (120) remains firmly fixed to the riser (3), preventing the sliding movement of the bend stiffener (4)/cap (5) assembly along said riser (3). This way the end fitting/connector (7'), on the free end of the riser (3), can be moved by traction until the cap (5) is successfully connected to the bell mouth (6), since the force needed to activate the dogs, applied on the free end of the riser (3), will be entirely transmitted to the bend stiffener (4)/cap (5) assembly by the compression plug (120) of the damping sleeve (100).

The damping sleeve (100) is also provided with a final lower tract, formed by a damping ring (130), fixed directly on the lower end of the intermediary part (112).

The damping ring (130) follows the shape of the main body (110) of the damping sleeve (100) and has a length equivalent to at least ⅓ of the total length of said damping sleeve (100).

The damping ring (130) is made from polymeric material and is capable of damping a potential blow between the bend stiffener (4)/cap (5) assembly and a stopper (9) located in the riser (3) at approximately 35 meters below the bend stiffener (4).

The upper part (111) of the main body (110) is further provided with four lugs (140), distributed equally along its external edge. The lugs (140) are made available for a potential need in the total execution of the activation of all of the dogs of the bell mouth (6).

In some cases, one of the dogs of the bell mouth (6) may not be activated. Employing the damping sleeve (100), in these cases, said lugs (140) are used as a support point so that the cables stop moving the cap (5) by traction, executing the anchoring, and the PLSV vessel, with its high rental costs, can be eradicated.

A prior intervention, using shallow diving for the recuperation and connection of the cap (5)/bend stiffener (4) assembly in the dogs of the bell mouth (6), does not interfere, in any case, with the implementation of the lines which are already interconnected.

The invention also comprised an anchoring method, much simpler and not dependent on the operations of teams of divers, and consequently, not subject to the influence of sea conditions.

The description of the method will be carried out on the basis of FIGS. 2 and 3, and it is important to emphasise that the inventive concept described below is not limited in character, and that a person skilled in the art will recognise the possibility of altering the sequence, to include or eliminate details of the operational stages depending on the load of each support, the operation depth or any other variable relating to the elements involved in the process, these alterations being encompassed in the scope of the method of the invention.

The initiation of the processes for carrying out the anchoring of the riser (3) on oil platforms includes the following stages:

1st—Install the damping sleeve (100) around the riser (3) directly on the lower end of the bend stiffener (4), still on the PLSV vessel;

This procedure is extremely simple and fast, given that the damping sleeve (100) is bipartite, and all that is required is the tightening of some screws in order for the task to be accomplished.

2nd—Connect the winch cable of the platform to the pull sling (8) and transfer the assembly formed by the cap (5) and bend stiffener (4) to the platform, immediately after the preceding stage;

Even though this stage is standard, it can, with the proposed technique, be carried out immediately after the preparation of the end of the riser (3).

In the prior art, this stage was dependent on the sea conditions for diving, since during this task it was necessary to connect the security straps (2) between the bell mouth (6) and the bend stiffener (4). In the event that diving could not be carried out, the PLSV would remain stationary on standby. In some regions there have already been cases of up to five days of rental for a standby vessel.

3rd—Start pushing the riser (3) until the cap (5) and bend stiffener (4) are connected in the dogs of the bell mouth (6).

4th—Pass the end of the riser (3) through the I-Tube and bell mouth (6).

5th—Continue to pull the riser (3) until its end reaches the anchoring point.

In the event that the cap (5)/bend stiffener (4) assembly is not moored in the dogs of the bell mouth (6), the damping sleeve (100) will maintain the assembly in position, as well as enabling this assembly to descend in a gentle and controlled manner until it reaches the stopper (9), thereby preventing any damage to the bend stiffener (4) and flexible duct.

If any failure of restriction between the compression plug (120) and the riser (3) occurs, the damping ring (130) will also be capable or protecting the bend stiffener (4) from any damaging impact.

With the damping sleeve (100) which is proposed here, the cables/safety straps (2) are dispensable. It will therefore be possible to carry out the connection of up to one complete assembly (bundle), without the accompaniment or direct assistance of a diver, releasing the PLSV vessel.

Later, if necessary, the intervention of a shallow diver could take place for the recuperation and connection of the cap (5)/bend stiffener (4) assembly in the dogs of the bell mouth (6), by means of the lugs (140), an operation which does not interfere in any case with the implementation of the interconnected lines.

This method enables a fast, efficient connection which is not dependent on sea conditions, making the calculation of the total costs of a package more predictable, and the whole operation more stable.

The invention was described here in reference to its preferred embodiments. It must, however, be made clear, that the invention is not limited to these embodiments, and the persons skilled in the art will immediately understand that alterations and substitutions can be carried out within the inventive concept described here.

The invention claimed is:

1. A damping sleeve comprising a bipartite structure with a cylindrical shape, provided with a core which extends coaxially from one end to the other of said structure, the core having a substantially cylindrical shape, with a diameter which is equal to or greater than the external diameter of a riser, the structure of the damping sleeve is demarcated in specific tracts: a main body which comprises an upper part and an intermediary part, and, a lower tract formed by a damping ring; the upper part, conically shaped, equivalent to that of the lower external end of a bend stiffener, in which it is directly encased, and the intermediary part is provided with a cavity along the whole internal circumference of the core; said cavity, in turn, is provided with a compression plug, firmly fitted to the riser; the lower tract, formed by the damping ring, is directly fixed on the lower end of the intermediary part; said damping ring follows the shape of the main body of the damping sleeve and has a length which is equivalent to at least ⅓ of the total length of the damping sleeve; the upper part of the main body is also provided with four lugs, distributed equally around its external edge.

2. The damping sleeve according to claim 1, wherein the upper part and the intermediary part are both formed from metallic material capable of supporting all of the various forces to which the damping sleeve will be subjected.

3. The damping sleeve according to claim 1, wherein the compression plug is formed from polymeric material and firmly fitted to the riser, the fit being able to prevent the sliding movement of the bend stiffener and a cap assembly along said riser, during the pulling, until the cap is successfully connected to a bell mouth.

4. The damping sleeve according to claim 1, wherein alternatively the compression plug is formed by two contiguous sections of polymeric materials and both with different properties, each one is programmed and fitted so as to resist specifically limited tensions.

5. The damping sleeve according to claim 1, wherein the damping sleeve is coupled on the free end of the riser, when this is still located on a PLSV vessel, being installed on the lower part of the bend stiffener by manual coupling, by means of screws, or any other fixing means.

6. The damping sleeve according to claim 1, eliminates the need for the use of fuse cables connected between a cap and a connector end fitting.

7. The damping sleeve according to claim 1, wherein the damping sleeve eradicates the need for the use of safety straps connected between the bend stiffener and a bell mouth.

8. The damping sleeve according to claim 1, wherein the damping sleeve carries out the interconnection of up to one whole assembly, without the direct accompaniment/assistance of a diver.

9. The damping sleeve according to claim 1, wherein the damping ring is made from polymeric material and is capable of damping a potential blow between the bend stiffener and a cap assembly and a stopper located in the riser at approximately 35 meters below the bend stiffener.

10. An anchoring method with the damping sleeve according to claim 1, the method comprising the following steps:

first, installing the damping sleeve around the riser directly on the lower end of the bend stiffener, still on a PLSV vessel;

second, connecting a winch cable of the platform to a pull sling and transfer an assembly formed by the bend stiffener and a cap to the platform, immediately after the preceding stage;

third, pushing the riser until the cap and the bend stiffener are connected in dogs of a bell mouth;

fourth, passing the end of the riser through an I-Tube and the bell mouth; and fifth, continuing to pull the riser until its end reaches an anchoring point.

* * * * *